US006031436A

United States Patent [19]

Fiedziuszko et al.

[11] Patent Number: 6,031,436

[45] Date of Patent: Feb. 29, 2000

[54] SINGLE AND DUAL MODE HELIX LOADED CAVITY FILTERS

[75] Inventors: Slawomir J. Fiedziuszko, Palo Alto; Raymond S. Kwok, San Jose, both of Calif.

[73] Assignee: Space Systems/Loral, Inc., Palo Alto, Calif.

[21] Appl. No.: 09/054,093

[22] Filed: Apr. 2, 1998

[51] Int. Cl.[7] ..... H01P 1/20

[52] U.S. Cl. ..... 333/202; 333/235

[58] Field of Search ..... 333/202, 207, 333/222, 219, 235, 208

[56] References Cited

U.S. PATENT DOCUMENTS

| | | | |
|---|---|---|---|
| 3,581,249 | 5/1971 | Spangler | 333/185 |
| 3,691,487 | 9/1972 | Yoshimoto | 333/202 |
| 3,728,731 | 4/1973 | Choi et al. | 333/202 X |
| 3,970,972 | 7/1976 | Bunner | 333/222 X |
| 4,101,854 | 7/1978 | Gikow et al. | 333/207 X |
| 4,453,146 | 6/1984 | Fiedziuszko | 333/212 |
| 4,459,571 | 7/1984 | Fraser | 333/202 |
| 4,682,131 | 7/1987 | May | 333/202 |
| 5,484,764 | 1/1996 | Fiedziuszko et al. | 505/210 |
| 5,831,496 | 11/1998 | Sonoda et al. | 333/134 X |

FOREIGN PATENT DOCUMENTS

| | | | |
|---|---|---|---|
| 3-234101 | 10/1991 | Japan | 333/202 |

*Primary Examiner*—Seungsook Ham
*Attorney, Agent, or Firm*—Kenneth W. Float

[57] ABSTRACT

Two helical resonator filters for applications in wireless and satellite communication systems. The present invention provides for single mode and dual mode microwave filters that employ evanescent waveguide cavities loaded with helical resonators. The structure of the present invention provides for a high Q factor in a miniature package. Two helical resonator filters are well adapted for use in wireless and satellite communication systems. The present invention provides for miniature filters utilizing single mode, high dielectric constant material loaded helical resonators, as well as higher order dual mode helical resonator loaded cavities. Both configurations can be used to realize advanced filters with non-adjacent coupling. The helical resonators may be loaded with high dielectric constant materials or ferrite materials for additional miniaturization and tunability. Either voltage or current tuning may be provided by the single mode and dual mode microwave filters.

20 Claims, 4 Drawing Sheets

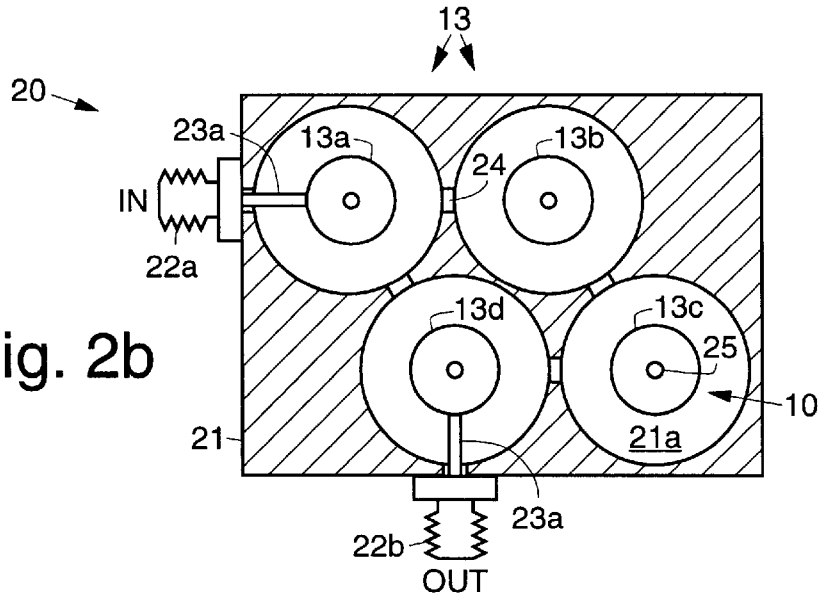
Fig. 2b
Fig. 3
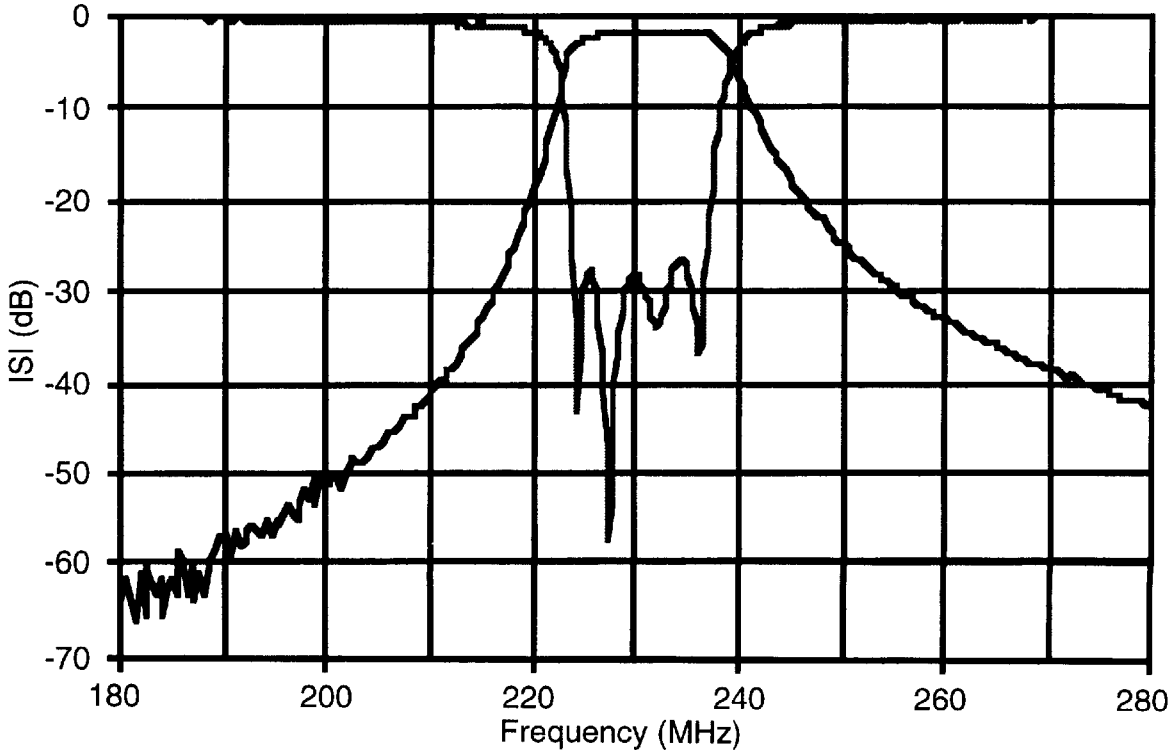

SINGLE AND DUAL MODE HELIX LOADED CAVITY FILTERS

BACKGROUND

The present invention relates generally to microwave filters, and more particularly, to improved miniaturized single mode and dual mode filters for use at relatively low microwave frequencies, such as for use in wireless and satellite communication systems.

Currently available wireless and personal communication system (PCS) devices operate at relatively low microwave frequencies, typically in the 800–2600 MHz frequency range. Previously available microwave filters for use in wireless and PCS devices have employed waveguide cavities, coaxial resonators and dielectric resonators. However, such conventional microwave filters are relatively large, which means that the devices containing them are unnecessarily large.

Helical resonator filters are well-known and widely used at lower microwave frequencies. As a microwave structure, the helix (helical resonator) is used for many applications in traveling-wave tubes, antennas, and delay lines. At lower frequencies, helical resonators operating in a fundamental mode (resembling a coaxial, quarter-wave resonator) are often used. Unfortunately, the Helmholtz equation is not separable in helical coordinates, as is discussed in a book by R. E. Collin, entitled "Field Theory of Guided Waves", McGraw-Hill Book Company, New York, 1960. Furthermore, to the inventors' knowledge, an analytical, rigorous solution for the general helical resonator has not yet been obtained. Various simplifying assumptions (e.g. sheath helix) have been used successfully in the past, but significant theoretical work needs to be completed to explore the full potential of the helical resonator.

Dual mode structures are widely used to realize high performance filters 20. Typical structures include an air cavity, a dielectric resonator loaded cavity, and a metal resonator loaded cavity. The air cavity is disclosed in a paper by A. E. Atia, et al. entitled "Narrow Bandpass Waveguide Filters", IEEE Trans. on Microwave Theory and Techniques, Vol. MTT-20, pp. 258–265, April 1972. The dielectric resonator loaded cavity is disclosed in a paper by S. J. Fiedziuszko entitled "Dual Mode Dielectric Resonator Loaded Cavity Filters" Trans. on Microwave Theory and Techniques, Vol. MTT-30, pp. 1311–1316, September 1982. The metal resonator loaded cavity is disclosed in", U.S. Pat. No. 5,484,764 entitled "Plural-mode Stacked Resonator Filter Including Superconductive Material Resonators", issued Jan. 16, 1996 to the assignee of the present invention, and in an article by Chi-Wang, et. al. entitled "Dual-Mode Conductor Loaded Cavity Filters", IEEE Transactions on Microwave Theory and Techniques, Vol. 45, pp. 1240–1246, August 1997.

In analyzing available field solutions for the sheath helix, the present inventors have found that these solutions are remarkably similar to the field solutions for a dielectric rod waveguide. Therefore, it has been determined by the present inventors that in many microwave structures utilizing devices that are based on the use of a dielectric waveguide (e.g. dielectric resonators), the use helical resonators offers the possibility of significant miniaturization, especially at lower microwave frequencies.

It would therefore be desirable to have microwave dual mode filters that are smaller in size and lighter weight than comparable conventional filters. It would be desirable to have microwave dual mode filters that have a high Q factor in a miniature package. It would be desirable to have microwave dual mode filters that are voltage or current tunable.

Accordingly, it is an objective of the present invention to provide for improved single mode and dual mode filters. It is another objective of the present invention to provide for improved microwave filters for use at relatively low microwave frequencies. It is another objective of the present invention to provide for improved single mode and dual mode filters that may be used in wireless and personal communication system (PCS) devices It is yet another objective of the present invention to provide for improved single mode and dual mode filters that have a high Q factor and are implemented in a miniature package. It is yet another objective of the present invention to provide for improved single mode and dual mode filters that are voltage or current tunable.

SUMMARY OF THE INVENTION

To accomplish the above and other objectives, the present invention provides for single mode and dual mode microwave filters that employ evanescent waveguide cavities loaded with helical resonators. The use of evanescent waveguide cavities loaded with helical resonators provides a high Q factor in a miniature package.

Two novel helical resonator filters for applications in wireless and satellite communication systems are provided by the present invention. The present invention provides for miniature filters utilizing single mode, high dielectric constant material loaded helical resonators, as well as higher order dual mode helical resonator loaded cavities. Both configurations can be used to realize advanced filters with non-adjacent coupling.

The helical resonators may be loaded with high dielectric constant materials or ferrite materials for additional miniaturization and tunability. Either voltage or current tuning may be provided by the single mode and dual mode microwave filters. The filters have a smaller size and lighter weight than conventional filters with comparable Q factors.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIGS. 2*a* and 2*b* illustrate alternative layouts of the single mode helical resonator filter of FIG. 2;

FIG. 3 illustrates the measured Chebyshev response of the single mode helical resonator filter with dielectric loading shown in FIG. 2;

DETAILED DESCRIPTION

Figure 1:
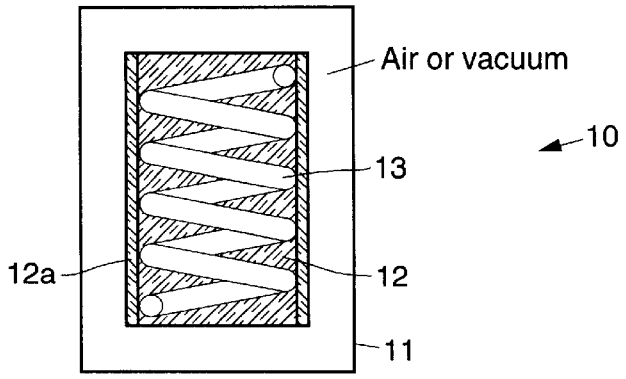
FIG. 1 illustrates a generalized helical resonator loaded cavity having dielectric loading in accordance with the principles of the present invention.

Referring to the drawing figures, FIG. 1 illustrates a generalized helical resonator loaded cavity 10 having dielectric loading in accordance with the principles of the present invention. A helical resonator 13 or helical winding 13 can be partly fully embedded in dielectric material 12. Loading is achieved using high dielectric constant dielectric material 12 or ferrite material 12 which is disposed within the cavity 11 surrounding the helical resonator 13. The present invention provides for single mode and dual mode filters (FIGS. 2 and 5) employing the helical resonator 13. It is to be understood that in the single mode filter, one end of the helical resonator 13 is grounded, and in the dual mode filter, the helical resonator 13 is suspended.

The helical resonator 13 or helical winding 13 may be made of copper or any other good electrical conductor, or may be constructed as a metalized stripe 13 on interior or exterior surface of dielectric tubes or blocks, or sandwiched between dielectric tubes or blocks, for example. This depicted in FIG. 1 by a helical winding 13 that is disposed within or around a material 12 having one dielectric constant and that is surrounded by a second material 12*a* having another dielectric constant. However, it is to be understood that the dielectric constant of these two materials 12, 12*a* may be the same. These materials have been used to produce filters 20 in accordance with the principles of the present invention as will be described below. High dielectric constant, low loss, temperature stable ceramic material may be used, which includes materials such as pure or doped titanate-based oxides, for example. Suitable ferrite material include a wide range of garnet or spinel ferrite materials, for example.

As for the helical resonator loaded cavity 10 shown in FIG. 1, specific design guidelines may be found in the "Handbook of Filter Synthesis", by A. I. Zverev, Chapter 9, Wiley & Sons, New York, 1976. The field solutions for a sheath helix can be found in the book entitled "Field Theory of Guided Waves", cited above and in the book entitled "Traveling Wave Tubes", by J. R. Pierce, D. Van Nostrand & Co., Princeton, N.J., 1950. The dominant fundamental mode (n=0) is used in designs described herein for single mode dielectric loaded helical resonator filters 20 (shown in FIG. 2). Higher order modes (n>0), usually hybrid modes, are utilized in dual mode helical resonator loaded cavity filters 20 described herein (shown in FIG. 5).

The basic idea for this structure oF the helical resonator loaded cavity filters 20 of the present invention is to utilize high dielectric constant, low loss, temperature stable ceramics to realize single mode helical resonators as described in the "Handbook of Filter Synthesis" cited above. This enables a significant reduction in size of the resonator and provides needed temperature compensation. The ceramic core may be metalized, forming a spiral conductor (a similar manufacturing process is currently used by the assignee of the present invention) to produce lower Q, larger coaxial ceramic resonators).

Design of the filter 20 typically follows guidelines found in the "Handbook of Filter Synthesis", except that in the present invention, the resonator has a height of a quarter-wave scaled by an effective dielectric constant. This is approximated by using a standard formula of an inverted microstrip. As an example, one reduced-to-practice resonator was designed for 230 MHz. At this frequency and with the chosen geometry, the effective dielectric constant was estimated to be 5.34.

Figure 2:
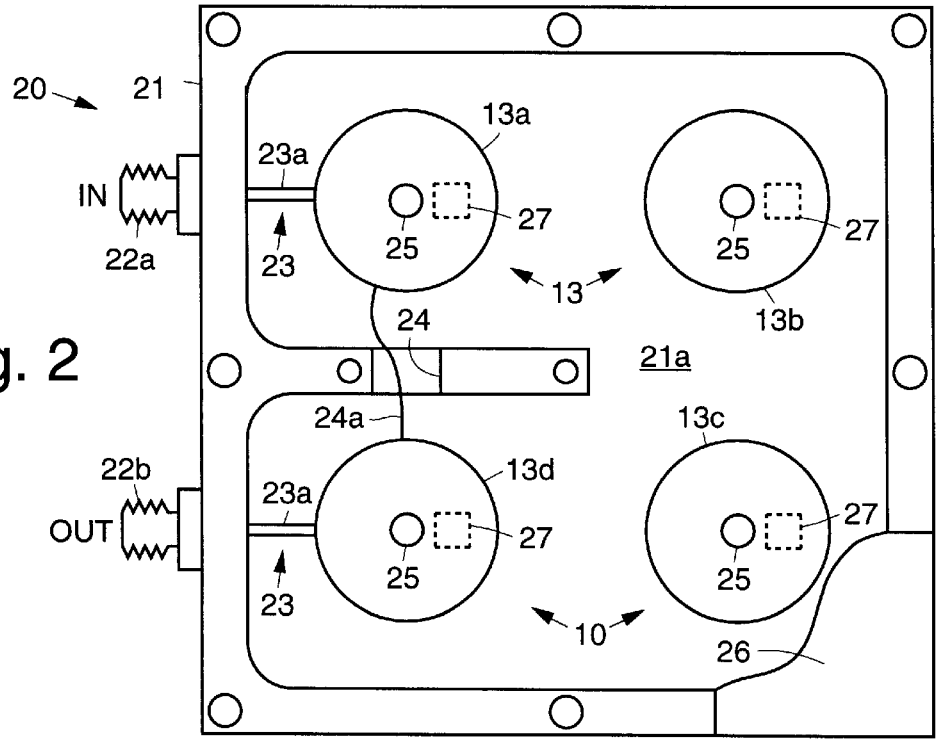
FIG. 2 illustrates a top view an embodiment of a microwave single mode helical resonator filter in accordance with the principles of the present invention.
Figure 2A:
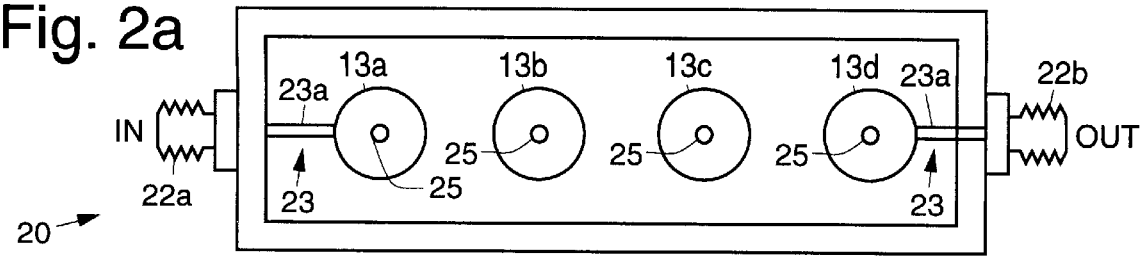

Referring now to FIG. 2, it illustrates a top view an embodiment of a microwave single mode helical resonator filter 20 in accordance with the principles of the present invention. Although a symmetrical four section filter 20 is shown in FIG. 2, it is to be understood that other configurations are envisioned by the present invention, including straight-line and slightly offset designs. FIGS. 2*a* and 2*b* illustrate alternative layouts of the single mode four section helical resonator filter 20 of FIG. 2. In FIG. 2*a*, the four helical resonators 13 are laid out in a linear fashion. In FIG. 2*b*, the four helical resonators 13 are offset from each other allowing implementation of a generalized quasi-elliptical response. Coupling irises 24 (coupling channels) may be employed between cavities 21*a* surrounding the four helical resonators 13, or coupling wires 24*a* (only one shown) may be used to couple between selected resonators 13. In general coupling irises or wires 24*a* may be used between any of the cavities to produce asymmetrical quasi-elliptical response. The respective sizes of the irises 24 or locations of ends of the wires 24*a* are selected to produce the desired amount or type of coupling.

The single mode helical resonator filter 20 comprises a housing 21 having an input port 22*a* and an output port 22*b*. The input arid output ports 22*a*, 22*b* may comprise coaxial connectors 22*a*, 22*b*, for example. A cavity 21 a is formed in the interior of the housing 21. Four helical resonators 13 are disposed in the cavity 21*a* The input port 22*a* is coupled by means of a direct conductive connection 23 (as shown) to a first helical resonator 13*a*. This connection may be made by coupling a center pin 23*a* of the coaxial connector 22*a* to the first helical resonator 13*a*, or by means of commonly known pick-up loops, for example. Second and third helical resonators 13*b*, 13*c* are disposed in the housing to form almost a square symmetrical resonator pattern. The second and third helical resonators 13*b*, 13*c* are physically separated from each other and from the first and forth output ports 22*a*, 22*b*. The output port 22*b* is also coupled by meais of a direct conductive connection (as shown) to a fourth helical resonator 13*d*. This connection may be made by coupling a center pin 23*a* of the coaxial connector 22*b* to the fourth helical resonator 13*d*, or by means of commonly known pick-up loops, for example. An iris 24 may be disposed between the first and fourth helical resonators 13*a*, 13*d* to control coupling therebetween. Similarly, an iris 24 may be disposed between all helical resonators 13*a*, 13*b*, 13*c*, 13*d* to control coupling therebetween.

Each of the helical resonators 13 comprise a dielectric tube 12 containing a helix, comprising the helical winding 13. The helical winding 13 are constructed in the manner described above with reference to FIG. 1. Capacitive loading members 25, such as tuning screws 25, for example, are disposed through a cover 26 of the housing directly above each of the respectively helical resonators 13. The capacitive loading members 25 or tuning screws 25 are used to capacitively load the respective resonators 13 and thereby control the passband of the filter 20. Alternatively, the helical resonators 13 may be capacitively loaded using chip capacitors 27 (shown in dashed lines) connected to the helical resonator 13 or metalized stripe 13.

As an example, helical resonators 13 having an OD=0.64 inches, ID=0.4 inches, and with a metalized stripe 0.1 inches wide, with pitch=0.2 inches, were reduced to practice using a ceramic tube having a dielectric constant=37. Several 4-pole filters 20 were built having the configuration shown in FIG. 2. The filter 20 shown in FIG. 2 was a proof-of concept design, and no attempt to maximize the Q-factor thereof was made. In spite of this, reasonable Q-factors for frequencies of 200–150 MHz have been obtained. The filters 20 are very simple and can be scaled to higher frequencies quite easily, which significantly improves the Q factor.

Figure 4:
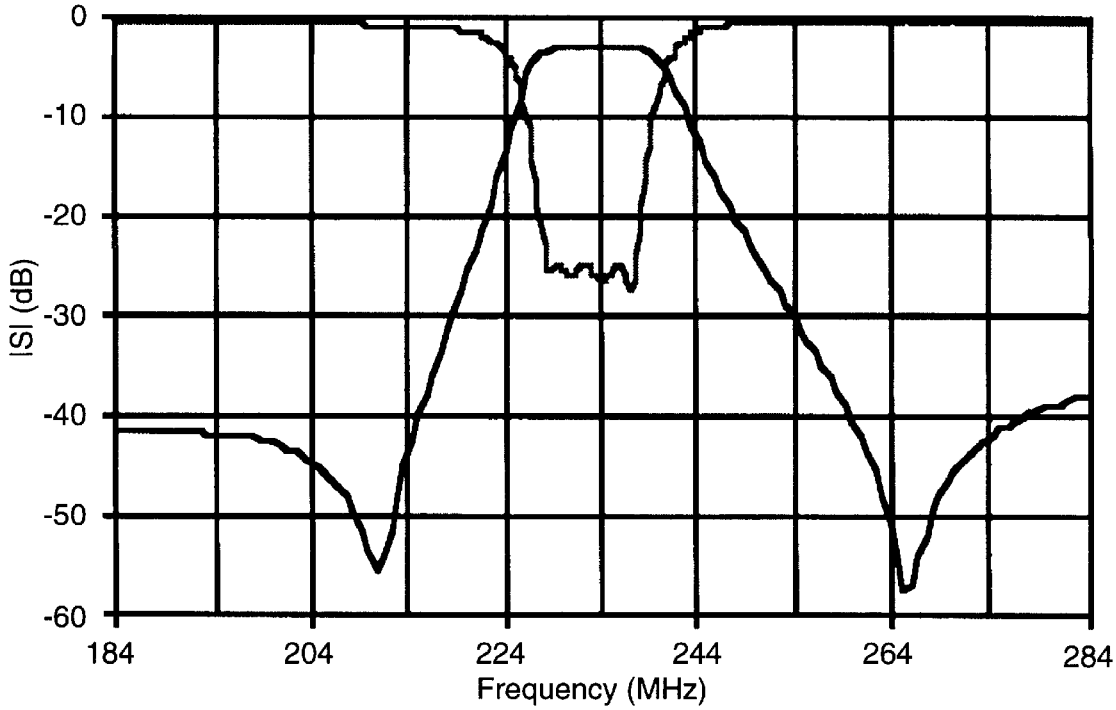
FIG. 4 illustrates the measured quasi-elliptical response of the single mode helical resonator filter with dielectric loading shown in FIG. 2.

Measured results for Chebyshev response and quasi-elliptical response filters 20 are shown in FIGS. 3 and 4. FIG. 3 illustrates the measured response of the single mode helical resonator filter 20 with dielectric loading shown in FIG. 2. FIG. 3 shows the Chebyshev response for a 4-pole filter 20. The bandwidth of the filter 20 is 13 MHz, and the insertion loss is 1.68 dB. FIG. 4 illustrates the measured response of the single mode helical resonator filter 20 with dielectric loading shown in FIG. 2. FIG. 4 shows the quasi-elliptical response for a 4-pole filter 20. The bandwidth of the filter 20 is 10 MHz, and the insertion loss is 2.7 dB.

In general, however, the single mode filter 20 may be configured using only a single resonator 13. In this configuration, the single mode filter 20 comprises a housing 21 with a cavity 21*a* formed therein, and a composite microwave resonator is disposed in the cavity 21*a* that comprises a cavity resonator. The cavity resonator comprises a helical resonator 13 comprised of a metallic helix and a material having a high dielectric constant and a high Q. The resonator 13 has a self-resonant frequency, and dimensions of the cavity resonator are selected so that the composite resonator has a first order resonance at a frequency near the self-resonant frequency. Tuning means 25 are provided for tuning the composite resonator to resonance at a desired frequency. Input means 22*a* are coupled through the housing 21 for coupling microwave energy into the cavity resonator. Output means 22*b* are coupled through the housing 21 for coupling a portion of the resonant energy out of the cavity resonator.

Figure 5:
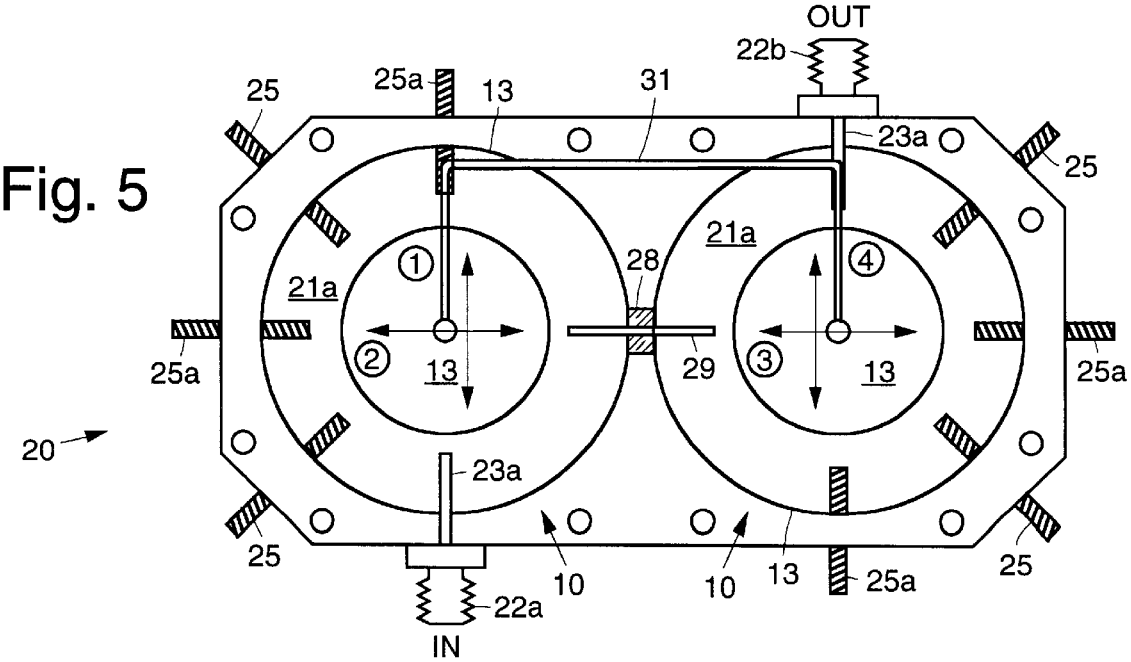
FIG. 5 illustrates a top view an embodiment of a dual mode helical resonator microwave filter in accordance with the principles of the present invention.

FIG. 5 illustrates a top view an embodiment of a dual mode helical resonator microwave filter 20 in accordance with the principles of the present invention. Although a two section filter 20 is shown in FIG. 5, it is to be understood that other configurations maybe readily constructed in accordance with the principles of the present invention. Thus, the present invention is not limited to the specific design shown in FIG. 5.

The dual mode helical resonator filter 20 comprises a housing 21 having an input port 22*a* and an output port 22*b*. The input and output ports 22*a*, 22*b* may be coaxial connectors, for example. Two circular cavities 21*a* is formed in the interior of the housing 21 and a dielectric plug 28 is disposed in a wall between the two cavities 21*a*. The input port 22*a* is disposed through one sidewall of the housing 21 and is coupled to one of the cavities 21*a*, while the output port 22*b* is disposed on the opposite sidewall of the housing 21 and is coupled to the other cavity 21*a*. However, it is to be understood that both ports 22*a*, 22*b* may be disposed on the same side of the housing 21, or on opposite ends of the housing 21 as is shown in FIG. 2*a*, if desired.

A helical resonator 13 is disposed in each of the cavities 21*a*. The helical resonators 13 may be disposed in air dielectric or in any other suitable dielectric material, such as Teflon®, Rexolite®, or high dielectric constant ceramic, for example.

The input and output ports 22*a*, 22*b* are coupled to the respective helical resonators 13 by means of E-probe connections 23*b*, for example. A plurality of tuning elements 25, such as tuning screws 25, for example, are disposed through the wall of the housing 21 which may be located at a variety of positions. For example, the tuning elements 25, or tuning screws 25, may be disposed in 45 degree wall sections of the housing 21 and/or in sidewall sections of the housing 21. The 45 degree tuning elements 25, or tuning screws 25, are used to couple between the dual orthogonal modes. In addition, frequency tuning screws 25*a* in the sidewalls may be used to adjust the respective resonant frequencies of the resonators 13.

The electric field direction of the four section filter 20 is depicted by the orthogonal double-headed arrows within the respective helical resonators 13 that are identified by encircled numbers (1–4). The four arrows schematically illustrate the electric field direction inside the respective helical resonators 13. The vertical arrows shown offset from the centers of the respective resonators 13 so that they do not overlap the ends of an insulated wire 31 connected between the respective helical resonators 13. The actual electric field spirals up and down along each respective helical resonator 13.

A metallic rod 29 comprising copper, for example, is disposed through the dielectric plug 28 and is used to couple energy between the second and third pole of the filter 20. The insulated wire 31, comprising insulated copper, for example, may be connected between the respective helical resonators 13 and is used to couple between the first and fourth poles to create a quasi-elliptical response.

Figure 6:
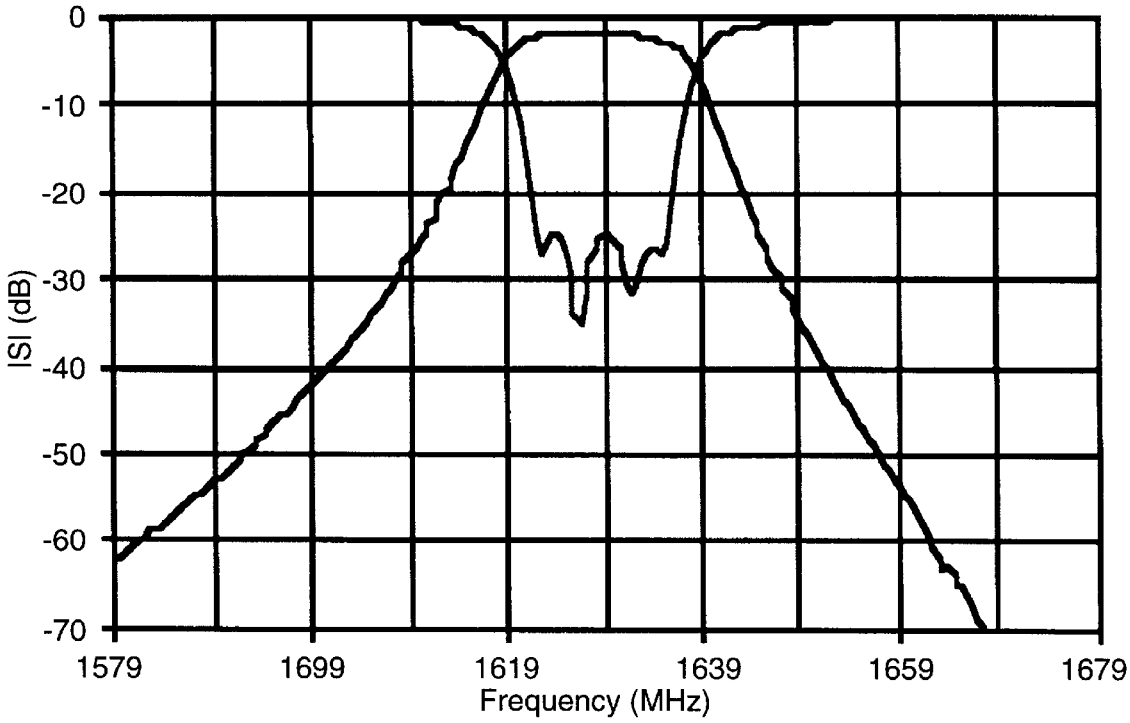
FIG. 6 illustrates the measured Chebyshev response of the dual mode helical resonator filter with dielectric loading shown in FIG. 5 without a coupling wire.
Figure 7:
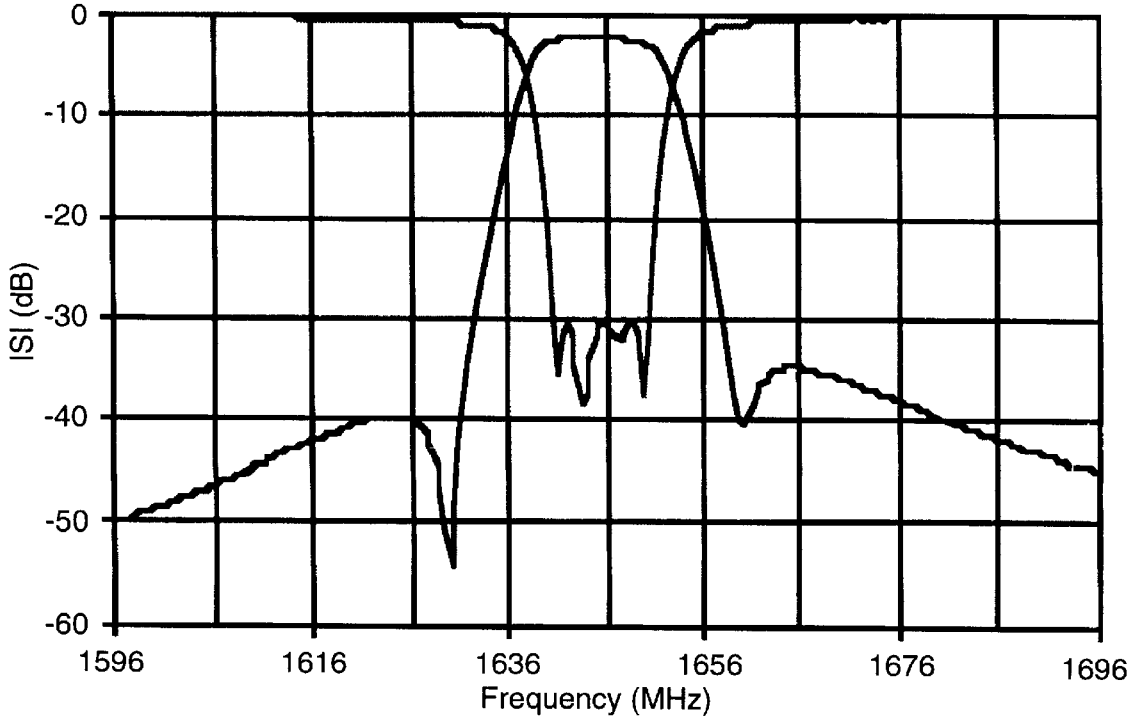
FIG. 7 illustrates the measured quasi-elliptical response of the dual mode helical resonator filter with dielectric loading shown in FIG. 5.

The present invention uses a half-wavelength helix loaded cavity 21 to realize the structure of a dual mode filter 20. Since higher order modes in helix (helical resonator 13) are used, the helix is larger than in single mode designs, such as the design described with reference to FIG. 2. However, a much higher Q-factor is obtained. As an example, helical resonators 13 used for dual mode filters 20 shown in FIG. 5 were manufactured from copper wire (#15) on a Teflon core that were 2 inches in diameter, had 4.5 turns, and a 1 inch height. The measured responses of realized 4-pole filters 20 are shown in FIGS. 6 and 7, wherein Chebyshev and quasi-elliptical responses are shown, respectively. Excellent results have been obtained, clearly demonstrating dual mode operation of the filters 20.

More specifically, FIG. 6 illustrates the measured response of the dual mode helical resonator filter 20 shown in FIG. 5 with Teflon as the dielectric material. FIG. 6 shows the Chebyshev response for a 4-pole filter 20 without the coupling wire 31. The bandwidth of the filter 20 is 14 MHz, insertion loss is 1.7 dB. FIG. 7 illustrates the measured response of the dual mode helical resonator filter 20 with dielectric loading shown in FIG. 5. FIG. 5 shows the quasi-elliptical response for a 4-pole filter 20. The bandwidth of the filter 20 is 10 MHz, and the insertion loss is 1.8 dB.

Again, and in general, the dual mode filter 20 may be configured using only a single resonator 13. In this configuration, the dual mode filter 20 comprises a housing 21 with a cavity 21*a* formed therein, and a composite microwave resonator comprising a cavity resonator having a helical resonator 13 disposed within the cavity 21*a*. The resonator 13 has a self-resonant frequency, and dimensions of the cavity resonator are selected so that the composite resonator has a first order resonance at a frequency near the self-resonant frequency. First tuning means 25 are provided for tuning the composite resonator to resonance at a desired frequency along a first axis. Second tuning means 25*a* are provided for tuning the composite resonator to resonance at a second frequency along a second axis that is orthogonal to the first axis. Input means 22*a* are coupled through the housing 21 for coupling microwave energy into the cavity resonator. Output means 22*b* are coupled through the housing 21 for coupling a portion of the resonant energy out of the cavity resonator.

Thus, improved single mode and dual mode filters for use at relatively low microwave frequencies have been disclosed. It is to be understood that the above-described embodiments are merely illustrative of some of the many specific embodiments that represent applications of the principles of the present invention. Clearly, numerous and other arrangements can be readily devised by those skilled in the art without departing from the scope of the invention. For example, the present invention is not limited to four-pole designs, and it is to be understood that filters containing other numbers of sections or poles are contemplated by the present invention.

What is claimed is:

1. A single mode dielectrically-loaded helical resonator filter comprising:

a housing having a cavity formed therein;

a composite microwave resonator comprising a cavity resonator and a helical resonator element comprised of a metallic helix and a material having a high dielectric constant and a high Q disposed within the cavity resonator, and wherein the helical resonator element has a self-resonant frequency, and wherein dimensions of the cavity resonator are selected so that the composite resonator has a first order resonance at a frequency near the self-resonant frequency;

tuning means for tuning the composite resonator to resonance at a desired frequency;

input means for coupling microwave energy into the cavity resonator; and output means for coupling a portion of the resonant energy out of the cavity resonator.

2. The helical resonator filter of claim 1 further comprising a capacitive loading member disposed above the helical resonator element for capacitively loading the resonator.

3. The helical resonator filter of claim 1 which comprises a plurality of composite microwave resonators and a plurality of tuning means for tuning the respective composite resonator elements, and wherein the respective distances between the resonator elements is used to control the coupling therebetween.

4. The helical resonator filter of claim 3 wherein the input and output means comprise input and output coaxial connectors and wherein first and last helical resonator elements are respectively coupled to the input and output coaxial connectors.

5. The helical resonator filter of claim 3 wherein the input and output ports comprise coaxial connectors and wherein first and last helical resonator elements are coupled to the coaxial connectors by means of pick-up loops.

6. The helical resonator filter of claim 3 further comprising an iris disposed between first and last helical resonator elements to control coupling therebetween.

7. The helical resonator filter of claim 3 further comprising irises disposed between selected helical resonator elements to control adjacent and non-adjacent coupling therebetween.

8. The helical resonator filter of claim 1 wherein the helical resonator element comprises a dielectric tube comprising a helical winding.

9. The helical resonator filter of claim 1 wherein the capacitive loading member comprises a tuning screw.

10. The helical resonator filter of claim 1 wherein the capacitive loading member comprises a tunable chip capacitor.

11. The helical resonator filter of claim 1 wherein the capacitive loading member comprises a tunable capacitor used in conjunction with a tuning screw.

12. A dual mode helical resonator filter comprising:

a housing having a cavity formed therein;

a composite microwave resonator comprising a cavity resonator and a helical resonator element disposed within the cavity resonator, and wherein the helical resonator element has a self-resonant frequency, and wherein dimensions of the cavity resonator are selected so that the composite resonator has a first order resonance at a frequency near the self-resonant frequency;

first tuning means for tuning the composite resonator to resonance at a desired frequency along a first axis;

second tuning means for tuning the composite resonator to resonance at a second frequency along a second axis that is orthogonal to the first axis;

input means for coupling microwave energy into the cavity resonator; and output means for coupling a portion of the resonant energy on one of the axes out of the cavity resonator.

13. The helical resonator filter of claim 12 comprising a plurality of composite microwave resonators having respective helical resonator elements, and further comprising an adjustable susceptance element disposed between selected helical resonators to provide for adjacent and non-adjacent coupling to create a generalized quasi-elliptical response.

14. The helical resonator filter of claim 13 wherein the adjustable susceptance element comprises an insulated wire disposed between the selected helical resonators.

15. The helical resonator filter of claim 12 wherein the helical resonator is disposed within air dielectric.

16. The helical resonator filter of claim 12 wherein the helical resonator is disposed within dielectric material from the group consisting of Teflon, Rexolite, and high dielectric constant ceramic.

17. The helical resonator filter of claim 12 wherein the input and output means are coupled to the helical resonator by means of E-probe connections.

18. The helical resonator filter of claim 12 wherein the input and output means are coupled to the helical resonator by means of pick-up loops.

19. The helical resonator filter of claim 12 wherein the tuning means are disposed in 45 degree wall sections of the housing to couple to orthogonal modes.

20. The helical resonator filter of claim 12 further comprising frequency tuning means disposed in sidewall sections of the housing to adjust the resonant frequency of the respective resonator.

* * * * *